US010322859B2

(12) United States Patent
Gaillot et al.

(10) Patent No.: US 10,322,859 B2
(45) Date of Patent: Jun. 18, 2019

(54) ADAPTER FOR CONNECTING A DISPENSER TO A CONTAINER

(71) Applicant: HOFFMANN-LA ROCHE INC., Little Falls, NJ (US)

(72) Inventors: Maxime Gaillot, Basel (CH); Mark Digby Teucher, Bath (GB); Daniel Higgins, Bristol (GB); Andrea Ceccaroni, Bristol (GB); Oliver Needham, Bristol (GB); Roberta Leah, Basel (CH); Declan Reilly, Basel (CH)

(73) Assignee: HOFFMANN-LA ROCHE INC., Little Falls, NJ (US)

( * ) Notice: Subject to any disclaimer, the term of this patent is extended or adjusted under 35 U.S.C. 154(b) by 0 days.

(21) Appl. No.: 15/756,521

(22) PCT Filed: Sep. 3, 2016

(86) PCT No.: PCT/EP2016/070786

§ 371 (c)(1),
(2) Date: Feb. 28, 2018

(87) PCT Pub. No.: WO2017/037271

PCT Pub. Date: Mar. 9, 2017

(65) Prior Publication Data

US 2018/0244446 A1 Aug. 30, 2018

(30) Foreign Application Priority Data

Sep. 4, 2015 (EP) ..... 15183971

(51) Int. Cl.
*B65D 47/12* (2006.01)
*B65D 55/08* (2006.01)

(52) U.S. Cl.
CPC ..... *B65D 55/0863* (2013.01); *B65D 47/122* (2013.01)

(58) Field of Classification Search
CPC ..... B65D 47/122; B65D 47/127; B65D 55/0863; B65D 55/08; B65D 50/048; B65D 50/065
See application file for complete search history.

(56) References Cited

U.S. PATENT DOCUMENTS 2,028,490 A 1/1936 Baker
2,201,205 A * 5/1940 Samburg ..... B65D 55/026 215/230

(Continued)

FOREIGN PATENT DOCUMENTS

FR 2 618 129 A1 1/1989
GB 2 302 867 A 2/1997
WO 2015/123666 A1 8/2015

OTHER PUBLICATIONS

International Search Report and Written Opinion dated Nov. 29, 2016 in corresponding International Patent Application No. PCT/EP2016/070786.

*Primary Examiner* — Nicholas J. Weiss
(74) *Attorney, Agent, or Firm* — Medler Ferro Woodhouse & Mills PLLC

(57) ABSTRACT

An adapter includes a body piece with an open container end side and a dispenser end side opposite to the container end side, and a collar piece arranged around the body piece. The dispenser end side of the body piece has an orifice. The body piece has a longitudinal axis, a cylindrical outer surface, and a cylindrical inner surface with a container thread oriented towards the container end side. The cylindrical outer surface of the body piece is equipped with a cap thread oriented towards the dispenser end side. The cap thread is arranged to interact with an inner thread of the cap for providing a child resistant closure. A collar piece is connected to the body piece that is freely rotatable relative to the body piece around the longitudinal axis of the body piece. The adapter can be used for efficiently and safely connecting a dispenser to container.

17 Claims, 7 Drawing Sheets

(56) References Cited

U.S. PATENT DOCUMENTS

| | | | | | |
|---|---|---|---|---|---|
| 3,482,723 | A * | 12/1969 | Esposito, Jr. | B65D 50/065 | 215/221 |
| 4,171,057 | A * | 10/1979 | Gach | B65D 50/048 | 215/211 |
| 4,709,823 | A * | 12/1987 | Beck | B65D 41/48 | 215/235 |
| 5,979,680 | A * | 11/1999 | Farside | B65D 50/046 | 215/211 |
| 2008/0105644 | A1 | 5/2008 | Douglas et al. | | |
| 2014/0190923 | A1 * | 7/2014 | Alpern | B65D 23/00 | 215/40 |

* cited by examiner

ADAPTER FOR CONNECTING A DISPENSER TO A CONTAINER

TECHNICAL FIELD

The present invention relates to an adapter according to the preamble of independent claim 1. Such adapters comprising a body piece with an open container end side and a dispenser end side opposite to the container end side, wherein the dispenser end side of the body piece has an orifice, the body piece has a longitudinal axis and a cylindrical outer surface with a cap thread oriented towards the dispenser end side, the cap thread of the outer surface of the body piece is arranged to interact with an inner thread of a cap for providing a child resistant closure, and the body piece has a cylindrical inner surface with a container thread oriented towards the container end side can be used for connecting a dispenser such as an oral dispenser or a syringe to a container such as a bottle having a neck with an exterior thread.

BACKGROUND ART

Today, many pharmaceutical products are administered in liquid form. However, many pharmaceutical products and particularly biopharmaceutical products are highly unstable in liquid form. Therefore, often pharmaceutical products are provided in a freeze-dried or lyophilized form in which they are essentially more stable and robust compared to its liquid form. Before being applied, the lyophilized pharmaceutical products are reconstituted or solved in a diluent or liquid.

Lyophilized pharmaceutical products or drugs are often delivered in a suitable container having a neck with an exterior thread such as in a glass or plastic bottle or the like. For safety reasons the container typically is closed by a child resistant closure (CRC) having a cap screwed on the neck. For preparing the drug before administration the cap is removed, a specified amount of a liquid is provided into the container, the cap is screwed on the neck of the container again and the drug is mixed with the liquid inside the container. For mixing the drug and the liquid, the closed container can be shaken until the drug is completely solved.

Once prepared the drug is ready for being administered in liquid form. To allow provision of a specific dosage out of the container oral dispensers such as scaled oral syringes can be used. Thereby, the container is opened by removing the CRC cap from the neck, a dosage of the drug is withdrawn by the oral dispenser, the drug is injected out of the oral dispenser into the mouth of a patient, the container is closed by replacing the cap on the neck again and the oral dispenser is washed.

For connecting oral dispensers to containers it is known to use adapters which allow for a precise and essentially leakage-free withdrawal of the drug from the container. Some of these adapters have to be pushed into the neck of the container. These adapters have an orifice through which the oral dispenser can access the interior of the container for withdrawing the drug. However, since the adapter and the container have to be tightly connected such pushing often requires a comparably strong insertion force. This can make the connecting difficult, for example with respect to preventing the container from falling or the like. Also, such pushed-in adapters can self-eject from the neck and have to be re-inserted before connecting an oral dispenser to the container. In addition, the handling of pushed-in adapters in some instances forces the user to touch or contact the dosing orifice of the pushed-in adapter.

For addressing these problems there are adapters used which are screwed on the neck of the container. For example, an adapter is known having a body piece and a jacket piece. The body and jacket pieces each have an essentially cylindrical shape. The body piece has an open container end side and an opposite end side with an orifice for being accessed by an oral dispenser. It further has an inner container thread oriented towards the container end side for being screwed on the neck of a container. The jacket piece has on its outer surface a cap thread onto which a cap of a CRC can be screwed.

The jacket piece is arranged on the body piece and completely covers it. The inner side of the jacket piece and the outer side of the body piece are equipped with ratchet means allowing the jacket piece to be rotated around the body piece in one direction but blocking a rotation of the jacket around the body piece in the other direction. In particular, the ratchet means are adapted such that the jacket piece and the body piece can together be screwed on the neck of the container. However, when turning the jacket piece in the other direction it rotates around the body piece and the adapter is not unscrewed from the container. Like this, the adapter can be mounted to the container such that it can not be removed therefore afterwards.

A drawback of this kind of known adapters is that they are comparably complicated by having plural pieces interacting in a comparably complicated manner. Thus, manufacture of the adapter can be comparably cumbersome. Furthermore, in some situations it can also be desired to remove the adapter from the container again which is not possible with such known adapters.

Therefore, there is a need for an adapter providing for an efficient and safe connection of a dispenser to a container particularly in order to allow the dispenser to precisely and safely withdraw a substance from the container.

DISCLOSURE OF THE INVENTION

According to the invention this need is settled by an adapter as it is defined by the features of independent claim 1. Preferred embodiments are subject of the dependent claims.

In particular, the invention deals with an adapter for connecting a dispenser to a container having a neck with an exterior thread. The adapter comprises a body piece with an open container end side and a dispenser end side opposite to the container end side. The dispenser end side of the body piece has an orifice. The body piece has a longitudinal axis, a cylindrical outer surface and a cylindrical inner surface with a container thread oriented towards the container end side. The cylindrical outer surface of the body piece is equipped with a cap thread oriented towards the dispenser end side. The cap thread of the cylindrical outer surface of the body piece is arranged to interact with an inner thread of a cap for providing a child resistant closure (CRC). The adapter further comprises a collar piece arranged around the body piece, wherein in a freely rotatable position the collar piece is connected to the body piece such that the collar piece is freely rotatable relative to the body piece around the longitudinal axis of the body piece.

The term "cylindrical" as used in connection with the outer and inner surfaces of the body piece as well as with other parts specified in the following can relate to an essentially cylindrical shape. In particular, it can relate to a circular cylindrical shape. The term does also include partially cylindrical shapes wherein the cylindrical portions have to be sufficiently large to allow a rotational movement.

For example, the cylindrical portions of the cylindrical outer surface of the body piece have to allow a rotational movement of the cap on the body piece in order to screw the cap onto the body piece.

The neck of the container can be ending in an opening of the container through which the interior of the container can be accessed. The container can particularly be a bottle. Such bottles are typically made of glass or a plastic material.

The adapter according to the invention can be referred to as double threaded screw-on bottle adapter (SOBA). It can be manufactured of a plastic material and particularly an inert plastic material.

The dispenser for which the adapter is intended to be used for can particularly be a dosage dispenser. Thereby, for example, it can be an oral dispenser such as a syringe or an enteral dispenser. Syringes are commonly used for dosing substances provided in containers.

The orifice can be embodied to receive the dispenser such as a dosage oral dispenser or enteral dispenser or a portion thereof such as a dispenser tip or the like. Thereby, it can be arranged such that the dispenser can be pushed or rotated through for accessing a substance in the interior of the container. In particular, receiving the dispenser can be implemented by simply manually pushing the dispenser onto the adapter thereby forcing a dispenser tip or the like through the orifice. Alternatively, for the same purpose the dispenser can be connected to the adapter, for example, by means of a standardized fitting such as the fitting for enteral connections in accordance with ISO standard 80369-3 (EN-Fit). In such embodiments, the adapter can be provided with a respective male or female portion of such a fitting. When the dispenser is removed, the orifice can automatically be closed and sealed again. The adapter according to the invention with its orifice on its dispenser end side allows for a convenient handling in particular preventing that the orifice is touched or contacted when being used.

The body piece can be essentially cylindrical. The cap can be a standard closure cap of the container. It can particularly be a CRC cap. The term "oriented towards" in connection with the cap thread and the container thread refers to a direction the respective thread is arranged to for being screwed. For example, the container thread is arranged to be screwed on the neck of the container. Thus, the container thread is oriented into the direction of the container or, likewise, the container end side of the body piece.

The term "longitudinal axis" in connection with the body piece can particularly relate to an axis along which the body piece mainly extends. In embodiments of the body piece being partly, essentially or fully cylindrical the longitudinal axis can be the main or central axis of the cylinder. In particular, the longitudinal axis can be identical to the axis around which the body piece is rotated in order to be screwed on the neck of the container.

The collar piece can be essentially ring shaped. The term "freely rotatable" in connection with the collar piece relates to allowing a movement around the body piece in both directions, i.e. clockwise and counter-clockwise. Thereby, the term is not intended to exclude any resistance of the relative rotational movement, e.g. induced by friction between the collar piece and the body piece, but a blockage or hindering of the rotational movement of the collar piece around the body piece. When being freely rotatable, the collar piece can be endlessly rotated around the body piece.

In use, the adapter is screwed on the container such that the container thread engages the exterior thread of the container. Thereby, the adapter and the container are connected in a seal manner. Since when the cap is screwed on the adapter, a screw force is also provided to the connection between the adapter and the container a robust long term sealing between the adapter and the container can be achieved. By means of the collar piece being freely rotatable, it can be prevented that the adapter is unscrewed from the container by turning the collar piece when it is in its freely rotatable position. In particular, when being screwed on the container and closed by the cap, the complete adapter can be saved from being unscrewed and removed from the container. Like this, a particularly safe connection of the dispenser to the container can be provided. The whole adapter-cap assembly can form part of a CRC of the bottle.

Preferably, the collar piece is movable from a torque-proof position along the longitudinal axis of the body piece to the freely rotatable position wherein and, in the torque-proof position, the collar piece is connected to the body piece such that the collar piece is non-rotatable relative to the body piece around the longitudinal axis of the body piece.

In accordance with such embodiments of the invention the torque-proof position of the collar piece is different from its freely rotatable position. In particular, the two positions are offset at different locations along the longitudinal axis of the body piece.

The term "non-rotatable" in connection with the collar piece relates to blocking a movement around the body piece. Thereby, the term is not intended to exclude a rotational clearance between the two pieces but an essential rotational movement of the collar piece around the body piece. For example, this term can be understood to exclude a rotation of the collar around the body piece of 5° or more, of 10° or more, of 20° or more or of 30° or more. In particular, by being non-rotatable relative to the body piece the collar piece forms a rotational unit together with the body piece. Like this, the complete adapter including the body piece and the collar piece can be rotated by turning the collar piece.

Preferably, the body piece and the collar piece have a snap structure which holds the collar piece in the torque-proof position. Such a snap structure allows for providing the adapter as a unit in the torque-proof position and then to snap into the freely rotatable position at a specific event. For example, like this the adapter can be provided as a unit before and while being screwed on the container such that a comfortable and efficient mounting of the adapter is possible. In the meantime, the collar and body pieces can be released from each other after the adapter is screwed on the container such that unintended removal of the adapter, e.g. by a child, can be prevented.

Thereby, the snap structure of the body piece and the collar piece preferably is arranged to release the collar piece into the freely rotatable position upon a force acting on the collar piece along the longitudinal axis of the body piece into the direction of the freely rotatable position. Such a force can be induced by a process or step involved in when mounting the adapter on the container or a cap on the adapter. In particular, it can be induced by the cap being part of the CRC when being screwed on the body piece of the adapter.

Preferably, the body piece is dimensioned such that the cap pushes the collar piece from the torque-proof position into the freely rotatable position when being screwed on the body piece. Like this, screwing the cap on the body piece can move the cap in a direction along the longitudinal axis of the body piece and, at a specific point, the cap abuts an edge of the collar piece thereby pushing the collar from the torque-proof into the freely rotatable position. This allows for a particular efficient implementation of the adapter as part of a CRC of the container.

Thereby, the snap structure preferably is arranged to prevent the collar piece from being moved towards the torque-proof position when being in the freely rotatable position. Such blocking of the collar piece can allow for safely providing the adapter on the container. In particular, it allows for preventing the collar piece being moved back into the torque-proof position once it is mounted on the container. Like this, unintended removal of the adapter from the container can be prevented.

Preferably, the snap structure comprises an outer saw tooth arranged at an inner surface of the collar piece and an inner saw tooth arranged at the outer surface of the body piece, wherein the outer saw tooth and the inner saw tooth are arranged to inter-engage. The outer and inner saw teeth can extend all around the inner surface of the collar piece and the outer surface of the body piece, respectively, or parts thereof. Such interacting saw teeth can allow for an efficient implementation of a snap structure in which a movement of the collar piece from the torque-proof into the freely rotatable position can be prevented.

Thereby, the outer saw tooth of the collar piece preferably comprises a ramp surface inclined with respect to the inner surface of the collar piece and a stop surface essentially perpendicular to the inner surface of the collar piece, the inner saw tooth of the body piece preferably comprises a ramp surface inclined with respect to the outer surface of the body piece and a stop surface essentially perpendicular to the outer surface of the body piece, the ramp surface of the outer saw tooth of the collar piece preferably is adjacent to the ramp surface of the inner saw tooth of the body piece when the collar piece is in the torque-proof position, and the stop surface of the outer saw tooth preferably is adjacent to the stop surface of the inner saw tooth when the collar piece is in the freely rotatable position.

Preferably, the body piece and the collar piece have a blocking structure which prevents a rotational movement of the collar piece relative to the body piece around the longitudinal axis of the body piece when the collar piece is in the torque-proof position. Such a blocking structure allows for a comparably easy, secure and efficient implementation of a non-rotatable arrangement in the torque-free position.

In particular, the blocking structure preferably comprises an outer blocking element arranged at an inner surface of the collar piece and an inner blocking element arranged at the body piece, wherein the outer blocking element engages the inner blocking element when the collar piece is in the torque-proof position and the outer blocking element and the inner blocking element do not engage when the collar piece is in the freely rotatable position.

Thereby, the outer blocking element of the collar piece preferably has a tangential contact surface and the inner blocking element of the body piece has a tangential contact surface, wherein the contact surface of the outer blocking element of the collar piece is adjacent to or abuts the contact surface of the inner blocking element of the body piece when the collar piece is in the torque-proof position.

The term "tangential" in this context can relate to a tangential direction of the cylindrical surfaces the blocking elements are arranged on. Thus, the tangential contact surfaces can radially extend such that they face a direction of a rotational movement, i.e. a tangential direction. Like this, an efficient blocking of a rotational movement of the collar piece relative to the body piece can be achieved.

Preferably, the orifice of the dispenser end side of the body piece is self-resealing wherein, it preferably comprises a valve or a septum. In particular, the orifice can comprise a bore closed by the valve or septum. Such a self-resealing orifice allows for preventing leakage of a substance when being withdrawn or removed from the container by the dispenser, i.e. a syringe for example.

Preferably, the collar piece comprises an outer surface provided with a gripping structure. Such a collar piece allow for an efficient handling of the adapter particularly when being screwed on the container.

Preferably, a ridge of the cap thread of the outer cylindrical surface of the body piece is circumferentially interrupted. Such an interrupted ridge allows the outer surface of the body piece to be partially flattened such that it can be gripped by a hand. Like this, an efficient handling of the adapter for mounting on and removing from the container can be achieved.

Preferably, the adapter comprises a dosing chamber which is arranged adjacent to the orifice such that it is accessible by the dispenser through the orifice. Such a dosing chamber may exactly define the dosage the dispenser can withdraw from the container. Thus, it is possible to assure removal of a predefined dosage from the container. The dosage chamber can, e.g. be arranged such that it is filled when the container is turned upside down but not when being in an upright position.

Preferably, the body piece is arranged for receiving the cap being the closure of the container. Typically containers used for providing pharmaceutical substances are delivered with CRC caps. By providing the adapter with a cap thread suitable to the cap of the container this cap can be also used for the adapter. Thus, an efficient implementation of the adapter can be achieved.

Preferably, the collar piece comprises a finger rest surface aligned transversal to a direction into which an actuator of the dispenser is pullable for loading when the dispenser is arranged in the orifice of the dispenser end side of the body piece. Such a finger rest surface, which can be formed on an outer surface of the collar piece, allows for a comfortable and efficient handling while withdrawing the substance from the container.

Thereby, the finger rest surface preferably is located at the container end side of the body piece. In particular, the finger rest surface is preferably formed by the collar piece being funnel shaped and expanding into the direction of the dispenser end side of the body piece. Such an design of the finger rest surface allows for an efficient implementation.

These and other aspects of the invention will be apparent from and elucidated with reference to the embodiments described hereinafter.

BRIEF DESCRIPTION OF THE DRAWINGS

The adapter according to the invention is described in more detail herein below by way of exemplary embodiments and with reference to the attached drawings, in which.

DESCRIPTION OF EMBODIMENTS

In the following description certain terms are used for reasons of convenience and are not intended to limit the invention. The terms "right", "left", "up", "down", "top", "bottom", "under" and "above" refer to directions in the figures. The terminology comprises the explicitly mentioned terms as well as their derivations and terms with a similar meaning. Also, spatially relative terms, such as "beneath", "below", "lower", "above", "upper", "proximal", "distal", and the like, may be used to describe one element's or feature's relationship to another element or feature as illustrated in the figures. These spatially relative terms are intended to encompass different positions and orientations of the devices in use or operation in addition to the position and orientation shown in the figures. For example, if a device in the figures is turned over, elements described as "below" or "beneath" other elements or features would then be "above" or "over" the other elements or features. Thus, the exemplary term "below" can encompass both positions and orientations of above and below. The devices may be otherwise oriented (rotated 90 degrees or at other orientations), and the spatially relative descriptors used herein interpreted accordingly. Likewise, descriptions of movement along and around various axes include various special device positions and orientations.

To avoid repetition in the figures and the descriptions of the various aspects and illustrative embodiments, it should be understood that many features are common to many aspects and embodiments. Omission of an aspect from a description or figure does not imply that the aspect is missing from embodiments that incorporate that aspect. Instead, the aspect may have been omitted for clarity and to avoid prolix description. In this context, the following applies to the rest of this description: If, in order to clarify the drawings, a figure contains reference signs which are not explained in the directly associated part of the description, then it is referred to previous or following description sections. Further, for reason of lucidity, if in a drawing not all features of a part are provided with reference signs it is referred to other drawings showing the same part. Like numbers in two or more figures represent the same or similar elements.

Figure 1:
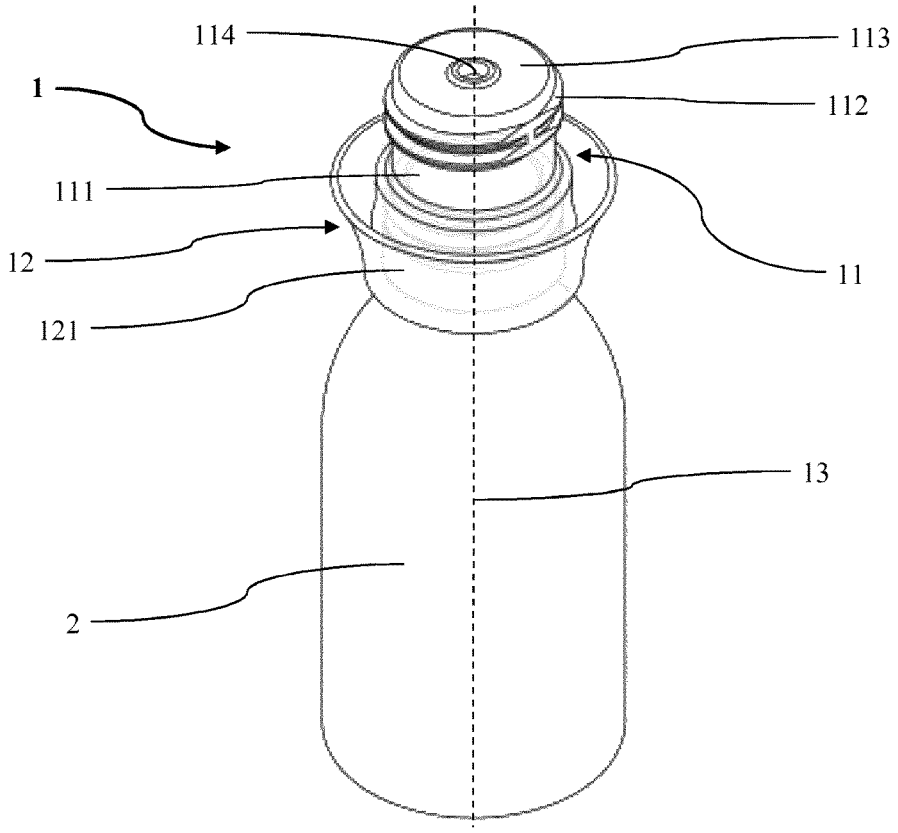
FIG. 1 shows a perspective view of a bottle onto which a first embodiment of an adapter according to the invention is mounted.

FIG. 1 shows a bottle 2 as a container being provided with a screw on bottle adapter (SOBA) as a first embodiment of an adapter 1 according to the invention. The bottle 2 has a hollow body into which a pharmaceutical substance is arranged in a liquid or powder form. The pharmaceutical substance can particularly be a previously lyophilized substance which is reconstituted.

The adapter 1 is designed as a two part assembly comprising a body piece 11 and a collar piece 12. The body piece 11 and the collar piece 12 may be manufactured from the same material, which preferably is a robust plastic material. The body piece 11 is essentially cylindrical shaped having a circle cylindrical outer surface 111, a top oral dispenser end side 113 and a bottom container end side opposite to the oral dispenser end side 113. The cylindrical outer surface 111 is provided with a cap thread 112 which is oriented towards the oral dispenser end side 113.

The body piece 11 has a central longitudinal axis 13 which is identical to a longitudinal axis of the bottle 2. The oral dispenser end side 113 has a central orifice 114 which can be accessed top town by a suitable oral dispenser such as an oral dispenser syringe.

The collar piece 12 has a circular funnel portion 121 which upwardly widens up in all directions. Thus, the collar piece 12 has its smallest diameter at a bottom end and it largest diameter at a top end.

In use, for withdrawing a dosage of the liquid substance prepared in the bottle 2, a tip of an oral dispenser such as an oral dosage syringe is pushed into the interior of the bottle 2 via the orifice 114 of the body piece 11 of the adapter 1. For inserting the tip through the orifice 114 the bottle 2 can be held by gripping the funnel 121 of the collar piece 12 of the adapter 1. Like this, the bottle 2 can conveniently be counter-pressed with respect to the oral dispenser.

Figure 2:
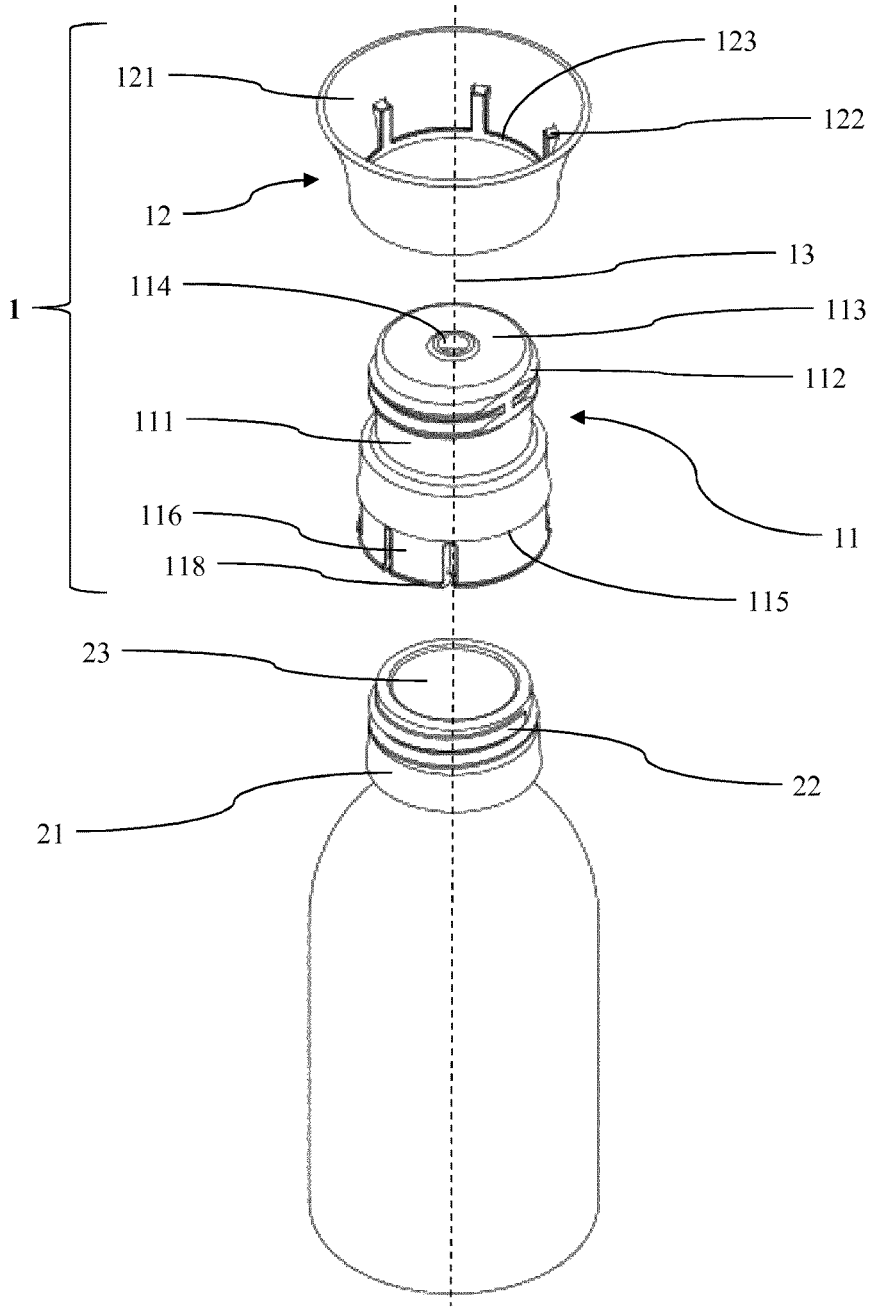
FIG. 2 shows an exploded perspective view of the bottle and the adapter of FIG. 1.

As shown in FIG. 2, the bottle has a neck 21 with a top opening 23. The interior of the bottle 2 is accessible via the opening 23 wherein the opening 23 is the only aperture of the bottle 2. Around the neck 21 an adapter thread 22 is formed which is oriented towards the opening 23 of the bottle 2 or towards a top end of the bottle 2.

The body piece 11 has a plurality of ring-segment shaped fins 116 of a snap structure towards its lower end. By separating a lower section of the ring-shaped or cylindrical body piece 11 in the plural fins 116 the lower section is provided with a certain elasticity of flexibility. At their bottom ends each of the fins 116 is equipped with a fin step 118 outwardly extending such that a horizontal radial abutting surface at its top end is formed. Above the fins 116 the body piece has a step extending outwardly from the lower section. Like this, a flange portion 115 with a horizontal radial abutting surface at its bottom end is formed.

The cap thread 112 of the body piece 11 has a ridge which circumferentially extends around the outer surface 111. Thereby, the ridge is circumferentially interrupted such that two opposing flattened sections are formed on cap thread 112. The flattened sections allow the body piece 1 to be comfortably gripped by a hand. Like this, it can be easily screwed on the neck 21 of the bottle 2.

The collar piece 12 has a plurality of vertical snap members 122 of the snap structure arranged about its inner circumference. The snap members 122 are shaped as rectangular bars which in contrast to the funnel portion 121 do not upwardly incline but extend vertically or parallel to the longitudinal axis 13. Furthermore, at its bottom end the collar piece 12 is equipped with a collar step 123. The collar step 123 outwardly extends in a radial direction such that a horizontal abutting surface is formed at the collar step 123.

Figure 3:
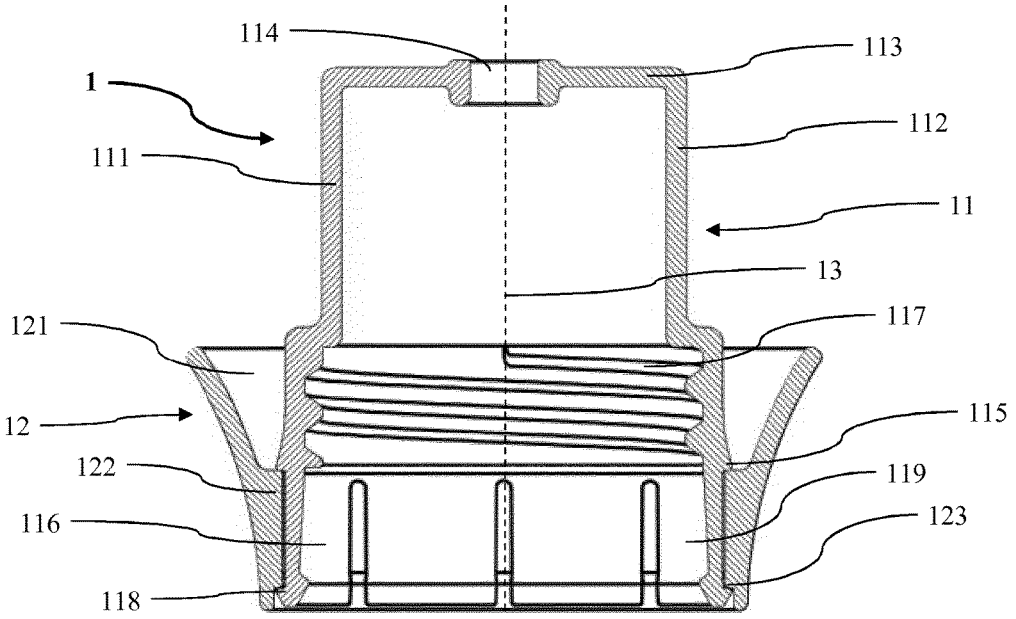
FIG. 3 shows a cross sectional view of the adapter of FIG. 1.

In FIG. 3 the adapter 1 is shown in an assembled state. The fins 116 of the body piece 11 are snapped in the snap members 122 of the collar piece 12. Thereby, the snap members 122 are located between the flange portion 115 and the fin steps 118. More particularly, top ends of the snap members 122 abut the horizontal abutting surface of the flange portion 115 and the horizontal abutting surface of the collar step 123 abuts the horizontal abutting surfaces of the fin steps 118. Like this, the body piece 11 and the collar piece 12 are axially fixed to each other such that they can not be moved along the longitudinal axis 13 in relation to each other. However, the collar piece 12 can be freely rotated around the body piece 11 in both directions, i.e. clockwise and counter-clockwise, such that the collar piece 12 of the adapter 1 is in a freely rotatable position.

As can also be seen in the cross sectional view of FIG. 3, the body piece 11 has an inner surface 119 which is provided with a bottle thread 117 as container thread. The bottle thread 117 is oriented towards the container end side of the adapter 1.

Figure 4:
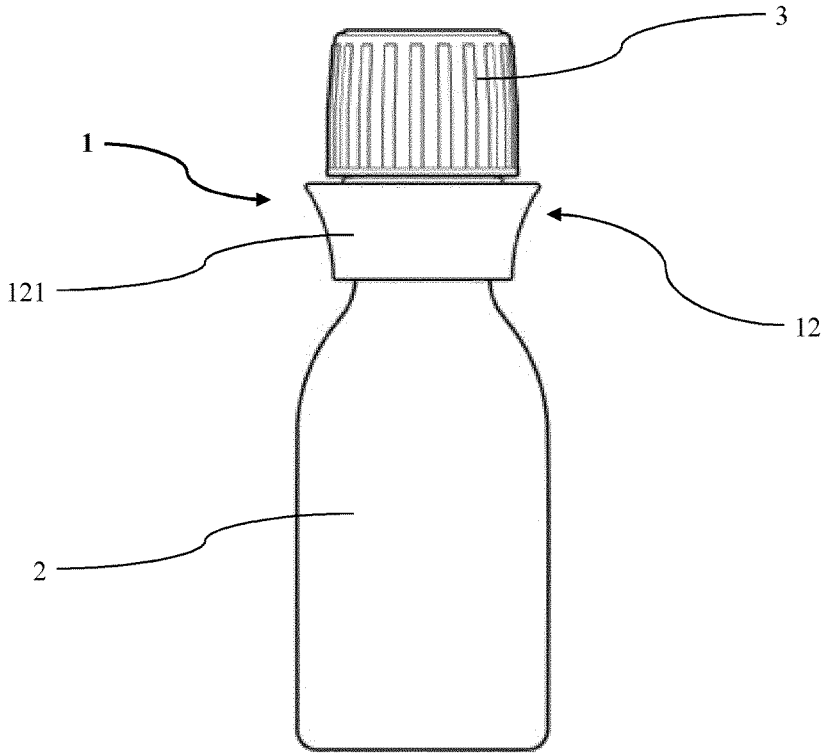
FIG. 4 shows a side view of the bottle and the adapter of FIG. 1, wherein a cap is screwed on the adapter.

FIG. 4 shows the adapter 1 screwed on the bottle 2. For screwing the adapter 1 on the bottle 2 it is rotated around its longitudinal axis 13 such that its bottle thread 117 engages the adapter thread 22 of the bottle 2. Like this, the adapter 1 is fixedly mounted to the bottle 2.

On the adapter 1 a cap 3 is screwed. In particular, an inner thread of the cap 3 engages the cap thread 112 of the body piece 11 of the adapter 1. The cap 3 together with the adapter 1 together form a child resistant closure (CRC) of the bottle 2.

When the adapter 1 being mounted to the bottle 2, the collar piece 12 is arranged around the neck 21 of the bottle 2. Thereby, it covers a portion of the body piece 1 which is not covered by the cap 3. Like this, it can be prevented that the adapter 1 is unscrewed from the bottle 2 as long as the cap 3 is on the adapter 1. In particular, somebody such as a child trying to unscrew the adapter 1 will either turn the cap 3 or the collar piece 12. Since the collar piece 12 is freely rotatable around the body piece 11 such turning will not unscrew the adapter 1 from the bottle 2. Thus, the adapter 1 is safely mounted to the bottle 2.

Figure 5:
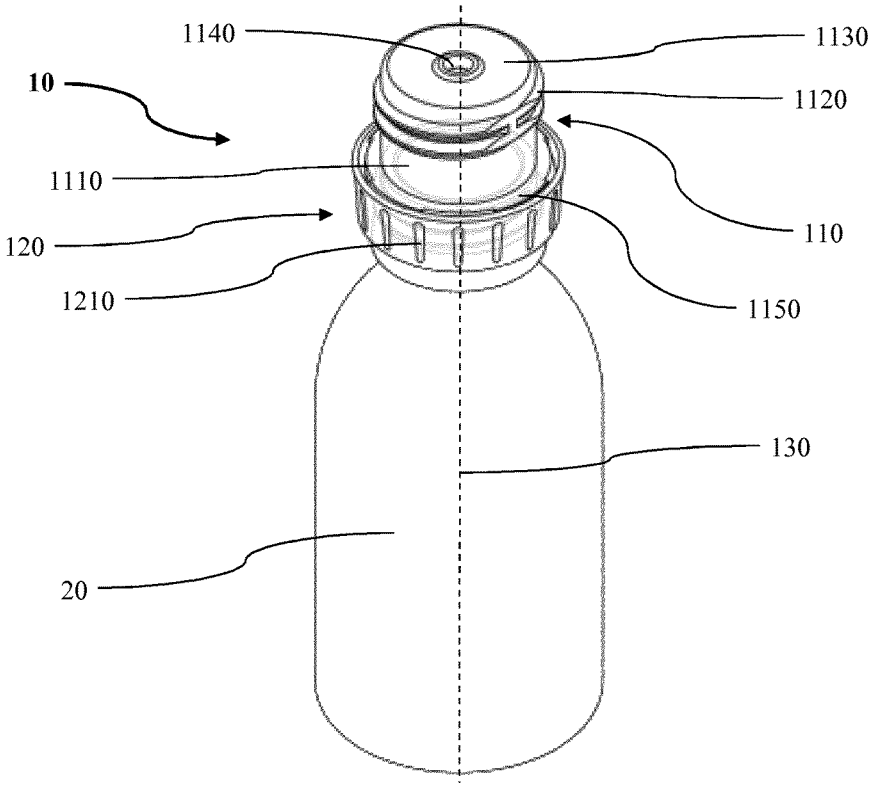
FIG. 5 shows a perspective view of a bottle onto which a second embodiment of an adapter according to the invention is mounted.

FIG. 5 shows a bottle 20 as a container being provided with a screw on bottle adapter (SOBA) as a second embodiment of an adapter 10 according to the invention. The bottle 20 has a hollow body into which a pharmaceutical substance is arranged in a liquid form. The pharmaceutical substance can particularly be a previously lyophilized substance which is reconstituted.

The adapter 10 is designed as a two part assembly comprising a body piece 110 and a collar piece 120. The body piece 110 and the collar piece 120 may be manufactured from the same material, which preferably is a robust plastic material. The body piece 110 is essentially cylindrically shaped having a circle cylindrical outer surface 1110, a top oral dispenser end side 1130 and a bottom container end side opposite to the oral dispenser end side 1130. The cylindrical outer surface 1110 is provided with a cap thread 1120 which is oriented towards the oral dispenser end side 1130. At its bottom end the outer surface 1110 passes over into a flange portion 1150.

The body piece 110 has a central longitudinal axis 130 which is identical to the longitudinal axis of the bottle 20. The oral dispenser end side 1130 has a central orifice 1140 which can be accessed top town by a suitable oral dispenser such as an oral dispenser syringe.

The collar piece 120 is essentially ring shaped. It has a circle cylindrical outer surface provided with a plurality of vertical gripping notches 1210.

Figure 6:
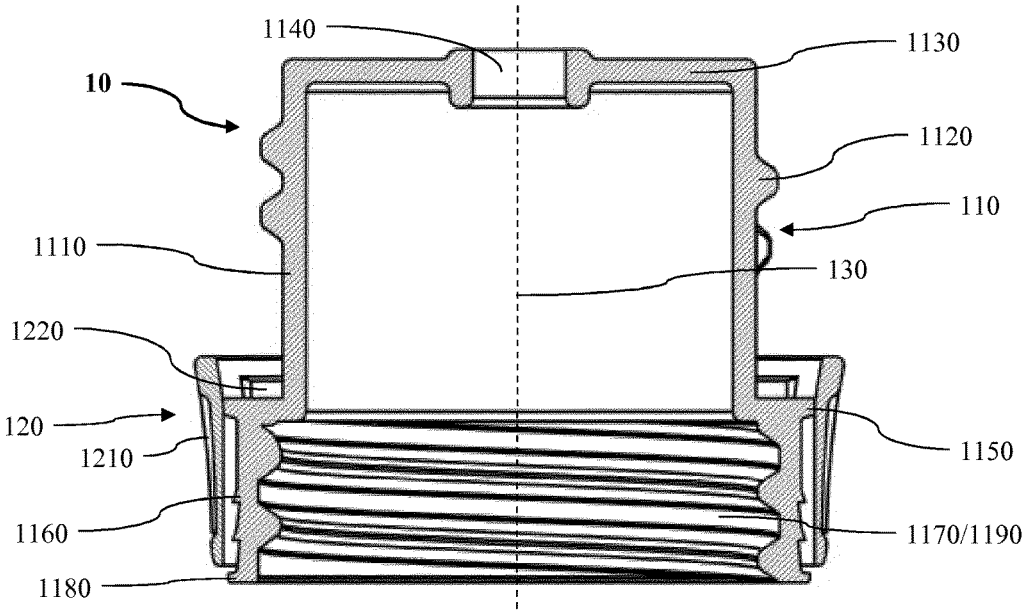
FIG. 6 shows a cross sectional view of the adapter of FIG. 5 in a torque-proof position.

In FIG. 6 the adapter 10 is shown in a torque-proof position. The body piece 110 being generally cylindrical has two sections of different dimension. An upper section comprising the outer surface 1110, the cap thread 1120, the cap end side 1130 and the orifice 1140 has smaller diameter. A lower section comprising an inner surface 1190 provided with a bottle thread 1170 as container thread has a larger diameter. The bottle thread 1170 is oriented towards and ends at the container end side of the adapter 10.

At its top end neighboring the upper section, the lower section of the body piece 110 is equipped with the flange portion 1150 which radially extends in an outward direction. The flange portion 1150 is circumferentially interrupted. In particular, as can also be seen in the perspective view of FIG. 5 the flange portion 1150 does not continuously but sequentially extend around the body piece 110. Like this, the flange portion 1150 is provided with plural interruptions. At its bottom end the lower section of the body piece 110 has an outwardly extending step 1180.

The collar piece 120 has a plurality of vertical snap members 1220 of a snap structure arranged about its inner circumference. The snap members 1220 are shaped as rectangular bars having vertical tangential abutting surfaces. In the torque-proof position, each of the snap members extends through one of the interruptions of the flange portion 1150 of the body piece 110. Thereby, when the collar piece 120 is rotated the tangential abutting surfaces of the snap members 1220 abut the flange portion 1150 of the body piece 110. Like this, the body piece 110 and the collar piece 120 are non-rotatable, i.e. rotationally blocked to each other, and can be rotated together as one single unit.

As can also be seen in FIG. 6, the outer surface of the lower section of the body piece 110 is provided with two inner saw teeth 1160 of the snap structure. The inner saw teeth 1160 are axially offset to each other. They each comprise an upper ramp surface inclined with respect to the outer surface 1110 of the body piece 110 and a lower horizontal stop surface perpendicular to the outer surface 1110 of the body piece 110.

In the torque-proof position shown in FIG. 6 the inner surface of the collar piece 120 is pressed against the flange portion 1150 of the body piece 110. Like this, the collar piece 120 is held by the body piece 110 by friction.

Figure 7:
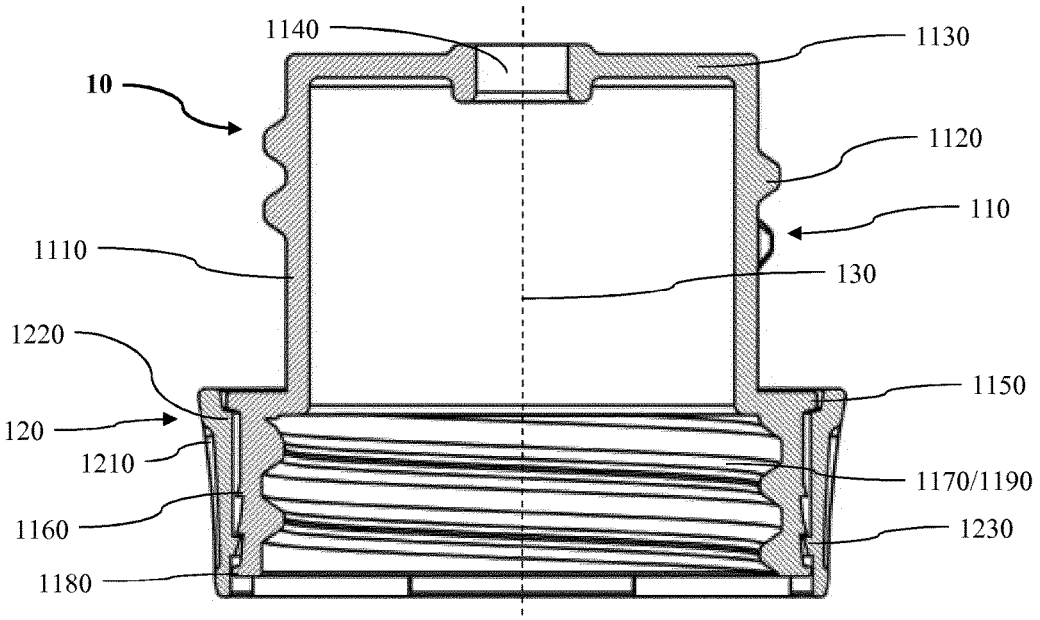
FIG. 7 shows a cross sectional view of the adapter of FIG. 5 in a freely rotatable position.

FIG. 7 shows the adapter 10 in a freely rotatable position. In this position, the collar piece 120 is axially or downwardly moved in relation to the body piece 110. Thereby, an outer saw tooth 1230 arranged at an inner surface of the collar piece 120 and the lower of the inner saw teeth 1160 of the body piece 110 inter-engage. The outer saw tooth 1230 of the collar piece 120 comprises a lower ramp surface inclined with respect to the inner surface of the collar piece 120 and a horizontal stop surface perpendicular to the inner surface of the collar piece 120.

At their top ends the snap members 1220 of the collar piece 120 abut a horizontal bottom surface of the flange portion 1150 of the body piece 110. Additionally, the stop surface of the saw tooth 1230 of the collar piece 120 abuts the stop surface of the lower saw tooth 1230 of the collar piece 120. Like this, the collar piece 120 is axially fixed with respect to the body piece 110 such that they cannot be moved along the longitudinal axis 130 relative to each other.

In the freely rotatable position the snap members 1220 of the collar piece 120 are arranged below the flange portion 1150 of the body piece 110. Therefore, they do not interact when the collar piece 120 is rotated with respect to the body piece 110. Thus, the collar piece 120 is freely rotatable around the body piece 110, i.e. clockwise and counterclockwise.

FIG. 8 to FIG. 12 show the adapter 110 when being mounted to the bottle 20. Typically, bottles used for pharmaceutical substances are provided with a cap 30 screwed on the bottle in a child resistant manner. Thus, before mounting the adapter 10 the cap 30 has to be unscrewed and removed from the bottle 20.

Figure 8:
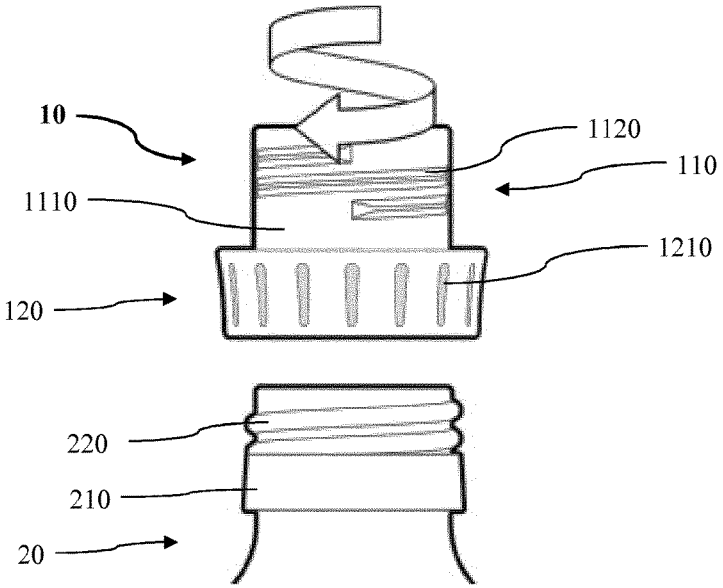
FIG. 8 shows a side view of the adapter of FIG. 5 while being screwed on the neck of the bottle of FIG. 5, a collar piece of the adapter being in the torque-proof position.

In a first step shown in FIG. 8 the adapter 10 is screwed on an adapter thread 220 provided at a neck 210 of the bottle 20. Thereby, the collar piece 120 is in the torque-proof position with respect to the body piece 110. Thus, the adapter 10 can be screwed as a unit on the bottle 20 wherein it can particularly be conveniently gripped by a hand at the outer surface of the collar piece 120.

When being screwed on the bottle 20 by a clockwise rotation of the adapter 10, the bottle thread 1170 of the body piece 110 engages the corresponding adapter thread 220 provided at the outer surface of the neck 210 of the bottle 20. Like this, the adapter can firmly but releasably be connected to the bottle 20.

Figure 9:
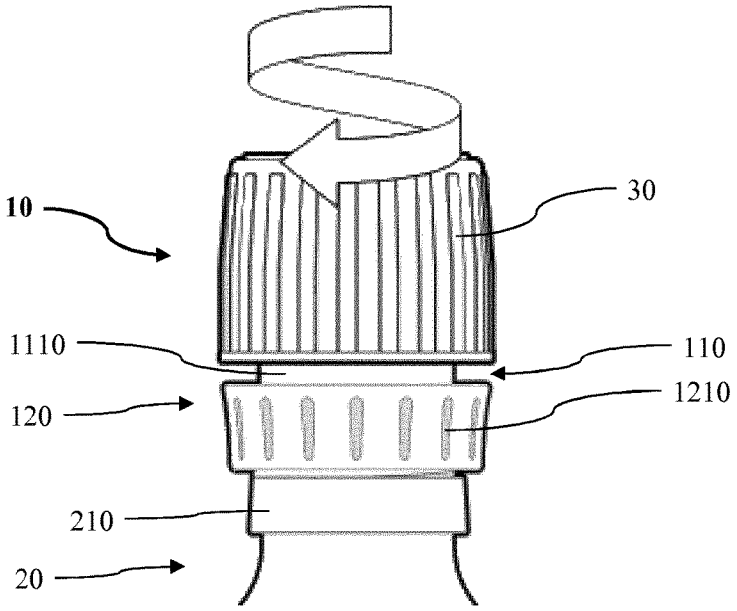
FIG. 9 shows a side view of the adapter of FIG. 5 after being screwed on the neck of the bottle of FIG. 5 while a cap being screwed on the adapter, the collar piece of the adapter being in the torque-proof position.

In a second step shown in FIG. 9 the cap 30 which has previously been removed from the bottle 20 is screwed on the adapter 10 by a clockwise rotation. Thereby, the cap thread 1120 of the body piece 110 of the adapter 10 interacts with an inner thread of the cap 30. In order that the cap 30 originating from the bottle 20 can also be used for the adapter 10 the outer surface 1110 and the cap thread 1120 of the body piece 110 are shaped essentially corresponding to the thread 220 and neck 210 of the bottle 20.

Figure 10:
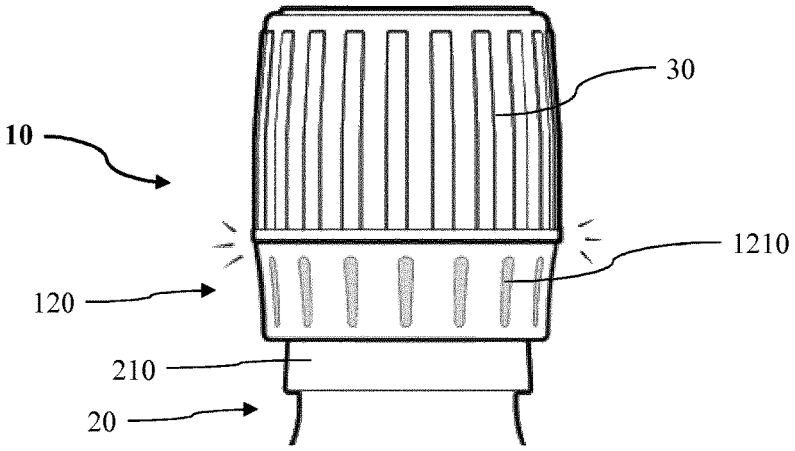
FIG. 10 shows a side view of the adapter of FIG. 5 after being screwed on the neck of the bottle of FIG. 5 while, when being screwed on the adapter, the cap of FIG. 9 pushes the collar piece of the adapter out of the torque-proof position.

As shown in FIG. 10, at a certain extent of screwing the cap 30 on the adapter 10 a bottom end of the cap 30 contacts the top end of the collar piece 120. Thereby, the cap 30 provides a force on the collar piece 120 and pushes it downwardly along the longitudinal axis 130. The collar piece 120 then snaps over the two inner saw teeth 1160 of the body piece 110 until it in the freely rotatable position. Since the outer saw tooth 1230 and the inner saw teeth 1160 each have ramp surfaces oriented towards each other, the collar piece 120 can be moved top down relative to the body piece 110.

Figure 11:
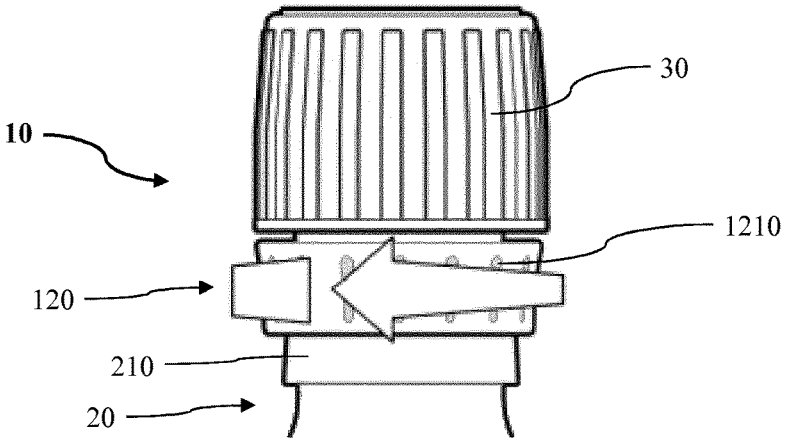
FIG. 11 shows a side view of the adapter of FIG. 5 after being screwed on the neck of the bottle of FIG. 5 and after the cap of FIG. 9 is completely screwed on the adapter, the collar piece of the adapter being in a freely rotatable position.
Figure 12:
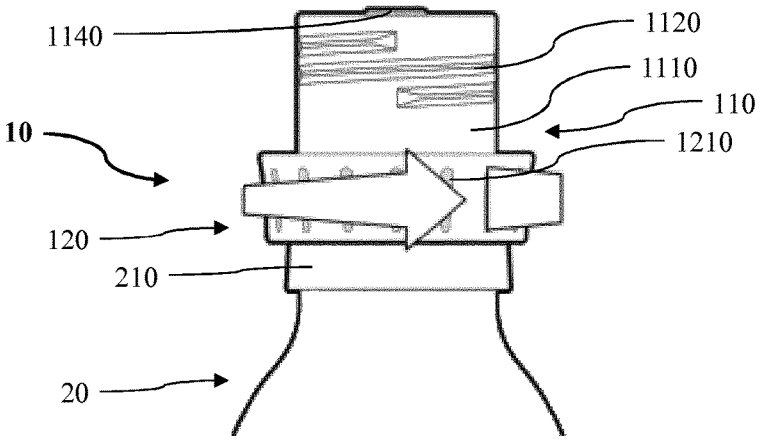
FIG. 12 shows a side view of the adapter of FIG. 5 after being screwed on the neck of the bottle of FIG. 5, the cap of FIG. 9 being removed from the adapter and the collar piece of the adapter being in the freely rotatable position.

In FIG. 11 the adapter 10 is shown in the freely rotatable position wherein the cap 30 is mounted on the adapter 10. As indicated by the arrow the collar piece 120 can freely be rotated in a clockwise direction. As indicated by the arrow in FIG. 12, the collar piece 120 is additionally rotatable in a counterclockwise direction. Thus, in the freely rotatable position the collar piece 120 is rotatable in both directions to any extent.

This description and the accompanying drawings that illustrate aspects and embodiments of the present invention should not be taken as limiting-the claims defining the protected invention. In other words, while the invention has been illustrated and described in detail in the drawings and foregoing description, such illustration and description are to be considered illustrative or exemplary and not restrictive. Various mechanical, compositional, structural, electrical, and operational changes may be made without departing from the spirit and scope of this description and the claims. In some instances, well-known circuits, structures and techniques have not been shown in detail in order not to obscure the invention. Thus, it will be understood that changes and modifications may be made by those of ordinary skill within the scope and spirit of the following claims. In particular, the present invention covers further embodiments with any combination of features from different embodiments described above and below.

The disclosure also covers all further features shown in the Figs. individually although they may not have been described in the afore or following description. Also, single alternatives of the embodiments described in the figures and the description and single alternatives of features thereof can be disclaimed from the subject matter of the invention or from disclosed subject matter. The disclosure comprises subject matter consisting of the features defined in the claims or the exemplary embodiments as well as subject matter comprising said features.

Furthermore, in the claims the word "comprising" does not exclude other elements or steps, and the indefinite article "a" or "an" does not exclude a plurality. A single unit or step may fulfil the functions of several features recited in the claims. The mere fact that certain measures are recited in mutually different dependent claims does not indicate that a combination of these measures cannot be used to advantage. The terms "essentially", "about", "approximately" and the like in connection with an attribute or a value particularly also define exactly the attribute or exactly the value, respectively. The term "about" in the context of a given numerate value or range refers to a value or range that is, e.g., within 20%, within 10%, within 5%, or within 2% of the given value or range. Components described as coupled or connected may be electrically or mechanically directly coupled, or they may be indirectly coupled via one or more intermediate components. Any reference signs in the claims should not be construed as limiting the scope.

The invention claimed is:

1. An adapter for connecting a dispenser to a container having a neck with an exterior thread, comprising:

a body piece with an open container end side and a dispenser end side opposite to the container end side, wherein the dispenser end side of the body piece has an orifice, the body piece has a longitudinal axis and a cylindrical outer surface, and the body piece has a cylindrical inner surface with a container thread oriented towards the container end side, wherein the cylindrical outer surface of the body piece has a cap thread oriented towards the dispenser end side, wherein the cap thread of the cylindrical outer surface of the body piece is arranged to interact with an inner thread of a cap for providing a child resistant closure, and the adapter further comprises a collar piece arranged around the body piece, wherein in a freely rotatable position the collar piece is connected to the body piece such that the collar piece is freely rotatable relative to the body piece around the longitudinal axis of the body piece, and the collar piece is movable from a torque-proof position along the longitudinal axis of the body piece to the freely rotatable position, and in the torque-proof position the collar piece is connected to the body piece such that the collar piece is non-rotatable relative to the body piece around the longitudinal axis of the body piece.

2. The adapter according to claim 1, wherein the body piece and the collar piece have a snap structure which holds the collar piece in the torque-proof position.

3. The adapter according to claim 2, wherein the snap structure of the body piece and the collar piece is arranged to release the collar piece into the freely rotatable position upon a force acting on the collar piece along the longitudinal axis of the body piece into the direction of the freely rotatable position.

4. The adapter according to claim 3, wherein the snap structure is arranged to prevent the collar piece from being moved towards the torque-proof position when being in the freely rotatable position.

5. The adapter according to claim 3, wherein the snap structure comprises an outer saw tooth arranged at an inner surface of the collar piece and an inner saw tooth arranged at the outer surface of the body piece, wherein the outer saw tooth and the inner saw tooth are arranged to inter-engage.

6. The adapter according to claim 5, wherein the outer saw tooth of the collar piece comprises a ramp surface inclined with respect to the inner surface of the collar piece and a stop surface essentially perpendicular to the inner surface of the collar piece, the inner saw tooth of the body piece comprises a ramp surface inclined with respect to the outer surface of the body piece and a stop surface essentially perpendicular to the outer surface of the body piece, the ramp surface of the outer saw tooth of the collar piece is adjacent to the ramp surface of the inner saw tooth of the body piece when the collar piece is in the torque-proof position, and the stop surface of the outer saw tooth is adjacent to the stop surface of the inner saw tooth when the collar piece is in the freely rotatable position.

7. The adapter according to claim 1, wherein the body piece and the collar piece have a blocking structure which prevents a rotational movement of the collar piece relative to the body piece around the longitudinal axis of the body piece when the collar piece is in the torque-proof position.

8. The adapter according to claim 7, wherein the blocking structure comprises an outer blocking element arranged at an inner surface of the collar piece and an inner blocking element arranged at the body piece, wherein the outer blocking element engages the inner blocking element when the collar piece is in the torque-proof position and the outer blocking element and the inner blocking element do not engage when the collar piece is in the freely rotatable position.

9. The adapter according to claim 8, wherein the outer blocking element of the collar piece has a tangential contact surface and the inner blocking element of the body piece has a tangential contact surface, wherein the contact surface of the outer blocking element of the collar piece abuts the contact surface of the inner blocking element of the body piece when the collar piece is in the torque-proof position.

10. The adapter according to claim 1, wherein the body piece is dimensioned such that the cap pushes the collar piece from a torque-proof position into the freely rotatable position when being screwed on the cap thread of the body piece.

11. The adapter according to claim 1, wherein the collar piece comprises an outer surface provided with a gripping structure.

12. The adapter according to claim 1, comprising a dosing chamber which is arranged adjacent to the orifice such that it is accessible by the dispenser through the orifice.

13. The adapter according to claim 1, wherein the body piece is arranged for receiving the cap being the closure of the container.

14. The adapter according to claim 1, wherein the collar piece comprises a finger rest surface aligned transverse to a direction into which an actuator of the dispenser is pullable for loading when the dispenser is arranged in the orifice of the dispenser end side of the body piece.

15. An adapter for connecting a dispenser to a container having a neck with an exterior thread, comprising:

a body piece with an open container end side and a dispenser end side opposite to the container end side, wherein the dispenser end side of the body piece has an orifice, and the orifice of the dispenser end side of the body piece is self-resealing, the body piece has a longitudinal axis and a cylindrical outer surface, and the body piece has a cylindrical inner surface with a container thread oriented towards the container end side, wherein the cylindrical outer surface of the body piece has a cap thread oriented towards the dispenser end side, wherein the cap thread of the cylindrical outer surface of the body piece is arranged to interact with an inner thread of a cap for providing a child resistant closure, and the adapter further comprises a collar piece arranged around the body piece, wherein in a freely rotatable position the collar piece is connected to the body piece such that the collar piece is freely rotatable relative to the body piece around the longitudinal axis of the body piece.

16. The adapter according to claim 15, wherein the orifice comprises a valve or septum.

17. An adapter for connecting a dispenser to a container having a neck with an exterior thread, comprising:

a body piece with an open container end side and a dispenser end side opposite to the container end side, wherein the dispenser end side of the body piece has an orifice, the body piece has a longitudinal axis and a cylindrical outer surface, and the body piece has a cylindrical inner surface with a container thread oriented towards the container end side, wherein the cylindrical outer surface of the body piece has a cap thread oriented towards the dispenser end side, wherein a ridge of the cap thread of the cylindrical outer surface of the body piece is circumferentially interrupted, and wherein the cap thread of the cylindrical outer surface of the body piece is arranged to interact with an inner thread of a cap for providing a child resistant closure, and the adapter further comprises a collar piece arranged around the body piece, wherein in a freely rotatable position the collar piece is connected to the body piece such that the collar piece is freely rotatable relative to the body piece around the longitudinal axis of the body piece.

* * * * *